US006933914B2

(12) United States Patent
Kanzaki et al.

(10) Patent No.: US 6,933,914 B2
(45) Date of Patent: Aug. 23, 2005

(54) IMAGE DISPLAY APPARATUS

(75) Inventors: Eisuke Kanzaki, Fujisawa (JP); Manabu Kodate, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 360 days.

(21) Appl. No.: 10/197,653

(22) Filed: Jul. 17, 2002

(65) Prior Publication Data

US 2003/0020721 A1 Jan. 30, 2003

(30) Foreign Application Priority Data

Jul. 24, 2001 (JP) ..... 2001-223685

(51) Int. Cl.[7] ..... G09G 3/36; G09G 3/30

(52) U.S. Cl. ..... 345/93; 345/78; 345/98; 345/99; 345/100

(58) Field of Search ..... 345/78, 87, 89, 345/90, 93, 95, 98–100, 103–104, 204–207, 690, 214

(56) References Cited

U.S. PATENT DOCUMENTS 5,880,702 A * 3/1999 Morimoto et al. ..... 345/1.1
5,986,724 A * 11/1999 Akiyama et al. ..... 349/41
6,437,767 B1 * 8/2002 Cairns et al. ..... 345/100

FOREIGN PATENT DOCUMENTS

| | | |
|---|---|---|
| EP | 1 058 232 A2 | 6/2000 |
| EP | 1 061 498 A2 | 12/2000 |
| JP | 05-188395 | 7/1993 |
| JP | 05-265045 | 10/1993 |
| JP | 05-303114 | 11/1993 |
| JP | 05-341734 | 12/1993 |
| JP | 06-138851 | 5/1994 |
| JP | 06-148680 | 5/1994 |
| JP | 08-248385 | 9/1996 |
| JP | 11-002837 | 6/1999 |
| JP | 2001-027751 | 1/2001 |
| JP | 2001-027893 | 1/2001 |
| JP | 2001-042842 | 2/2001 |

* cited by examiner

*Primary Examiner*—Vijay Shankar
(74) *Attorney, Agent, or Firm*—John R. Pivnichny; Arthur J. Samodovitz

(57) ABSTRACT

A process for supplying display signals from a storage device to a multiplicity of pixel electrodes in an image display apparatus. Display signals are serially stored into the storage device for a significant part of a line of the image display apparatus. After the display signals are stored for the part of the line into the storage device, the display signals are outputted while additional display signals for another part of the line are concurrently stored into the storage device. The outputting step is performed at a faster rate than the concurrent storing step. Consequently, the size of the storage device can be limited.

17 Claims, 12 Drawing Sheets

IMAGE DISPLAY APPARATUS

BACKGROUND OF THE INVENTION

The present invention relates to image display apparatus, such as a liquid crystal display.

An active matrix liquid crystal display which uses a thin film transistor (TFT) as a switching device is known today. In such an active matrix type liquid crystal display apparatus, a liquid crystal material is sealed between a TFT array substrate and a color filter substrate. A TFT array substrate contains scan signal lines and display signal lines in a matrix. Thin film transistors are disposed on intersections thereof, and a color filter substrate is spaced from the TFT array substrate by a specified interval. A display signal voltage is applied to the liquid crystal material under control of the thin film transistors. An electro optic effect on the liquid crystal causes a display.

Higher definition requires an increased number of pixels in the active matrix type liquid crystal display apparatus. This requires an increased number of display signal lines, scan signal lines and drivers along with increased storage. In addition, an electrode pitch for connecting the drive ICs and the TFT array substrate is narrowed, thus causing difficulty in connection thereof and lowering yield in connection work.

In order to solve these problems, many proposals have been made to reduce the number of drive ICs and increase a pitch between connection terminals by applying a potential to two or more adjacent pixels from one display signal line in time division. For example, such proposals are disclosed in Japanese Patent Laid-Open Nos. Hei 6 (1994)-138851, Hei 6 (1994)-148680, Hei 11 (1999)-2837, Hei 5 (1993)-265045, Hei 5 (1993)-188395 and Hei 5 (1993)-303114.

As object of the present invention is to provide a high definition, active matrix type liquid crystal display apparatus with reduced storage requirements.

Another object of the present invention is to provide a high definition, active matrix type liquid crystal display apparatus with simplified circuitry.

SUMMARY OF THE INVENTION

The invention resides in a process for supplying display signals from a storage device to a multiplicity of pixel electrodes in an image display apparatus. Display signals are serially stored into the storage device for a significant part of a line of the image display apparatus. After the display signals are stored for the part of the line into the storage device, the display signals are outputted while additional display signals for another part of the line are concurrently stored into the storage device. The outputting step is performed at a faster rate than the concurrent storing step.

According to one feature of the present invention, an image display apparatus comprises: a plurality of display signal lines for supplying display signals; a first pixel electrode and a second pixel electrode, to which the display signals are supplied from a common display signal line; a scan signal line for supplying scan signals to the first pixel electrode and the second pixel electrode; and a signal processing circuit for generating the display signals based on a first signal corresponding to the first pixel electrode and a second signal corresponding to the second pixel electrode and for supplying the display signals to the display signal lines. The signal processing circuit includes: a first storage area for storing the first signal; a second storage area for storing the second signal, the second storage area being larger than the first storage area in storage capacity; a distributing circuit for distributing the first signal to the first storage area and the second signal to the second storage area; and an output selecting circuit for selecting any of the first signal stored in the first storage area and the second signal stored in the second storage area and for outputting the selected signal.

The above image display apparatus of the present invention comprises the first storage area for storing the first signal, and the second storage area for storing the second signal, the second storage area being larger than the first storage area in storage capacity. Between the first signal and the second signal, which are stored in the first storage area and the second storage area respectively by the distributing circuit, the first signal stored in the first storage area relatively small in storage capacity is outputted prior to the second signal by an instruction of the output selecting circuit. After this output is ended, the second signal stored in the second storage area relatively large in storage capacity is outputted. Specifically, the first signal to be inputted to the first pixel electrode and the second signal to be inputted to the second pixel electrode are continuously supplied. Here, since the first signal is priorly outputted by the instruction of the output selecting circuit, the first storage area can save the storage capacity to be smaller than that of the second storage area. Specifically, according to the present invention, the capacity of circuit for storing display signals can be reduced.

Moreover, since the image display apparatus of the present invention has a structure, in which the display signals are supplied to two pixel electrodes of the first pixel electrode and the second pixel electrode, the number of display signal lines can be decreased in half or lower of the number of pixels arranged in one row.

In the image display apparatus of the present invention, with regard to the first and second signals inputted from the outside during a same horizontal cycle, the output selecting circuit can output the first signal stored in the first storage area prior to the second signal stored in the second storage area.

In the image display apparatus of the present invention, the signal processing circuit can store the first signal in the first storage area during a specified first horizontal cycle and can store the second signal in the second storage area, and can execute a control to output the first signal stored in the first storage area during the first horizontal cycle.

Moreover, in the image display apparatus of the present invention, during a second horizontal cycle following the first horizontal cycle, the signal processing circuit can execute the control to complete the output of the second signal stored in the second storage area during the first horizontal cycle.

Moreover, in the image display apparatus of the present invention, the signal processing circuit can execute a control to complete the output of the first signal from the first storage area and the output of the second signal from the second storage area during one horizontal cycle.

Furthermore, in the image display apparatus of the present invention, the first storage area and the second storage area desirably include First-in First-out functions for data input and output.

Moreover, at least one of the first storage area and the second storage area can be constituted of a plurality of storing circuit. Specifically, the first storage area and the second storage area are not limited to the case of having single structures.

Furthermore, the first storage area and the second storage area can be logically constituted and physically constituted as a logical storage apparatus of one system.

Moreover, the present invention can achieve the foregoing objects also by a novel image display apparatus to be described below. Specifically, the image display apparatus of the present invention comprises an image display device having a plurality of pixels arrayed in a matrix and having display signal lines and scan signal lines provided therein, the display signal lines being for supplying display signals to respective pixels and the scan signal lines being for supplying scan signals to the respective pixels, and signal processing circuit for generating the display signals based on signals inputted from an outside and for supplying the display signals to the display signal lines, wherein, in the image display device, a first pixel electrode and a second pixel electrode are connected to the display signal line common thereto, the first and second pixel electrodes existing in a same row, and the signal processing circuit includes a first storage area having a capacity for storing a first display signal to be inputted to the first pixel electrode in amount corresponding to a ½ horizontal cycle relating to the first display signal and a second storage area having a capacity for storing a second display signal to be inputted to the second pixel electrode in amount corresponding to one horizontal cycle relating to the second display signal.

In the image display apparatus of the present invention, the first storage area has a capacity for storing the display signals corresponding to the ½ horizontal cycle, and the second storage area has a capacity for storing the display signals corresponding to the one horizontal cycle. Specifically, though it has been heretofore required that each of the first storage area and the second storage area has the capacity for storing the display signals corresponding to one horizontal cycle, it is sufficient if one of the storage areas has the capacity for storing the display signals corresponding to ½ horizontal cycle. This is because the signal processing circuit executes the control as below. Specifically, when the first display signal is inputted during a specified horizontal cycle, and when the first storage area stores the first display signal in amount corresponding to the ½ horizontal cycle relating to the first display signal, the signal processing circuit executes a control to output the first display signal in storage order.

With regard to the second display signal, the signal processing circuit receives the second display signal during the specified one horizontal cycle, and after the second storage area stores the second display signal in amount corresponding to the one horizontal cycle relating to the second display signal, executes a control to output the second display signal in storage order.

For the image display device applied to the image display apparatus of the present invention, the following is desirable. Specifically, the present invention desirably uses the image display device including a plurality of display signal lines for supplying display signals, a plurality of scan signal lines for supplying scan signals, a first pixel electrode and a second pixel electrode, to which the display signals are supplied from a common display signal line, a first switching device having a gate electrode for controlling supply of the display signals, the first switching device being disposed between the common display signal line and the first pixel electrode; a second switching device disposed between the gate electrode of the first switching device and a specified scan signal line, and a third switching device for controlling supply of the display signals to the second pixel electrode, the third switching device being connected to the specified scan signal line.

This image display device can supply the display signals from the common and specified signal line to the first pixel electrode and the second pixel electrode. Accordingly, in the case where M rows of pixels exist, the number of signal lines, that is, the number of data drivers can be set at M/2.

Moreover, the image display device adopts a configuration, in which the second switching device is disposed between the specified scan signal line and the gate electrode of the first switching device, which is disposed between the first pixel electrode and the specified scan signal line. Specifically, two switching device are not arranged in series between the first pixel electrode and the specified display signal line. Accordingly, it is not necessary to enlarge the switching device represented by TFT. Meanwhile, the third switching device is connected to the second pixel electrode, and when the third switching device is turned on, the display signals from the signal line can be supplied to the second pixel electrode.

Note that description has been made here for the two pixel electrodes, that is, the first pixel electrode and the second pixel electrode. However, the above purpose of the present invention can be applied to an aspect where three or more pixel electrodes share one signal line. As a matter of course, the present invention also includes this aspect.

Moreover, it is also desirable that the present invention use the image display device including: a first pixel electrode and a second pixel electrode disposed between an n-th (n: positive integer) scan signal line and an n+1-th scan signal line, to which display signals from a specified signal line are supplied; a first switching mechanism allowing the scan signals to pass therethrough when both of the n+1-th scan signal line and an n+m-th (m: integer except 0 and 1) scan signal line are selected; and a second switching mechanism allowing the scan signals to pass therethrough to the second pixel electrode when the n+1-th scan signal line is selected.

In this image display device, the first pixel electrode and the second pixel electrode share the specified signal line, and the display signals are supplied from the signal line. Moreover, in the image display device of the present invention, the first pixel electrode is supplied with the scan signals when both of the n+1-th scan signal line and the n+m-th (m: integer except 0 and 1) scan signal line are selected, and the second pixel electrode is supplied with the scan signals when the n+1-th scan signal line is selected. Accordingly, by selecting the number m, the storage capacity can be formed between each of the first and second pixel electrodes and an upstream scan signal line, which is not involved in the drive of the first and second pixel electrodes.

Moreover, the present invention provides a novel display signal supply apparatus to be described below for supplying display signals to an active matrix type image display device. Specifically, the display signal supply apparatus of the present invention comprises: a distributing circuit for distributing the display signals inputted thereto from an outside into a first signal and a second signal; a first storage area for storing the first signal obtained by distributing the display signals by the distributing circuit; a second storage area for storing the second signal obtained by distributing the display signals by the distributing circuit; and signal outputting circuit for instructing an output of the first signal from the first storage area prior to entire storage of the first signal in the first storage area.

In the display signal supply apparatus of the present invention, the signal outputting circuit can instruct an output of the second signal stored in the second storage area from the second storage area after the first signal in specified amount is outputted from the first storage area. Then, the distributing circuit distributes display signals for m pieces of pixels into the first signal for m/2 pieces of pixels and the second signal for the m/2 pieces of pixels, the signals being inputted circuit from the outside. Moreover, the signal outputting instructs the output of the priorly stored first signal from the first storage area when the first signal for m/4 pieces of pixels is stored in the first storage area, and instructs the output of the second signal stored in the second storage area from the second storage area after the first signal for the m/2 pieces of pixels is outputted from the first storage area.

When the first signal for the m/4 pieces of pixels is stored in the first storage area, the display signal supply apparatus of the present invention outputs the priorly stored first signal from the first storage area in storage order. Accordingly, it is not necessary for the first storage area to have the storage capacity for the m/2 pieces of pixels.

The display signal supply apparatus of the present invention can further comprise: a signal control circuit for receiving display signals and clock signals from the outside and for outputting the display signals and control signals; and a driver for receiving the display signals and the control signals, both being outputted from the signal control circuit, and for supplying the display signals to the image display device based on the control signals. In this case, the first storage area and the second storage area can be provided in the signal control circuit or in the driver.

The present invention provides a display signal supply method for an image display device to be described below.

Specifically, the present invention is a display signal supply method for an image display device, the image display device including a plurality of display signal lines for supplying display signals, a plurality of scan signal lines for supplying scan signals, a first pixel electrode disposed between the scan signal lines adjacent to each other and connected to a specified display signal line, and a second pixel electrode connected to the specified display signal line, the display signal supply method comprising the steps of: receiving display signals for m pieces of pixels; after a first display signal corresponding to the first pixel electrode is stored for m/4 pieces of pixels, while storing the first display signal subsequent thereto, outputting the first display signal priorly stored to the first pixel electrode; and after an output of the first display signal is completed, outputting a second display signal corresponding to the second pixel electrode to the second pixel electrode, the second display signal being stored for m/2 pieces of pixels.

In the display signal supply method for an image display device of the present invention, the storage of the first display signal and the second display signal can be started in different areas from the same time. Moreover, the storage and the output of the first display signal and the storage of the second display signal can be performed during one horizontal cycle.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE PREFERRED EMBODIMENTS

Hereinafter, description will be made for an image display apparatus of the present invention based on an embodiment regarding a liquid crystal display apparatus.

Figure 1:
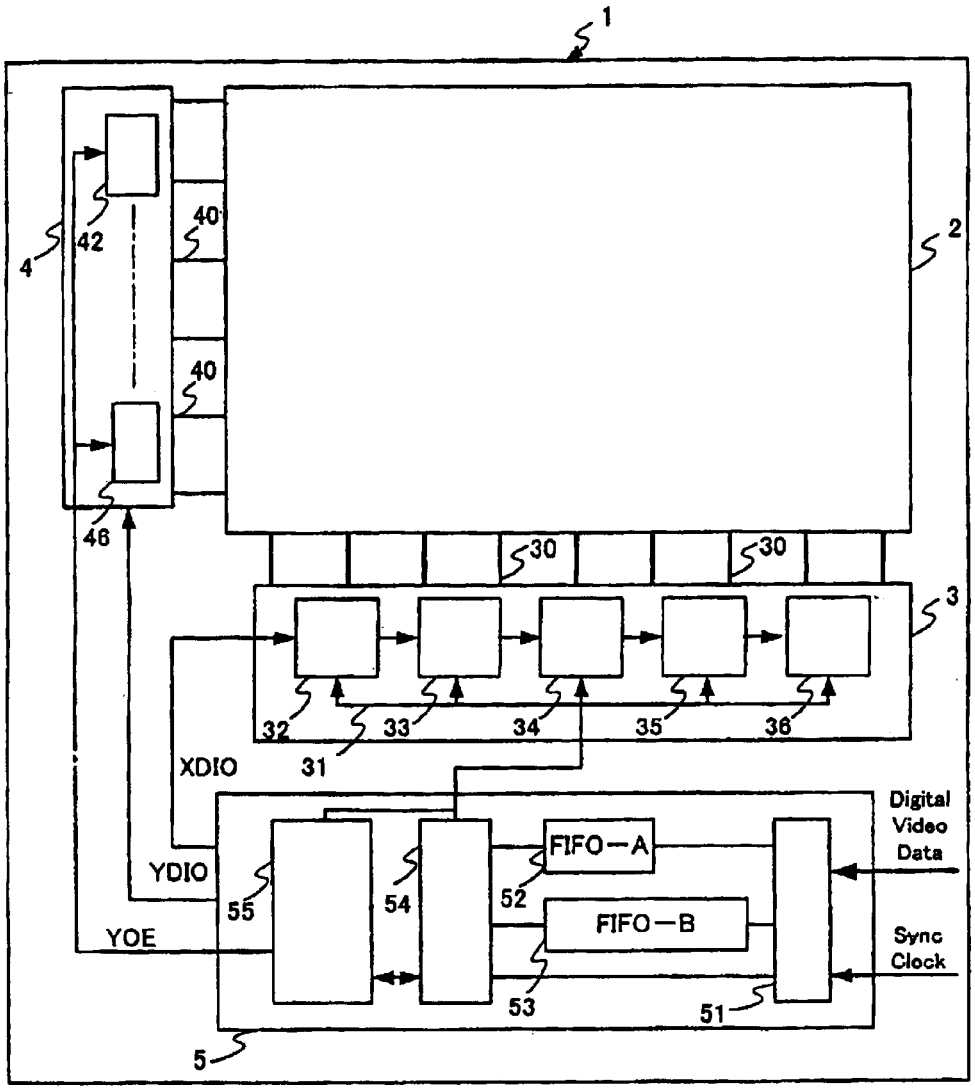
FIG. 1 is a view schematically showing a configuration of a liquid crystal display apparatus according to the present invention.
Figure 2:
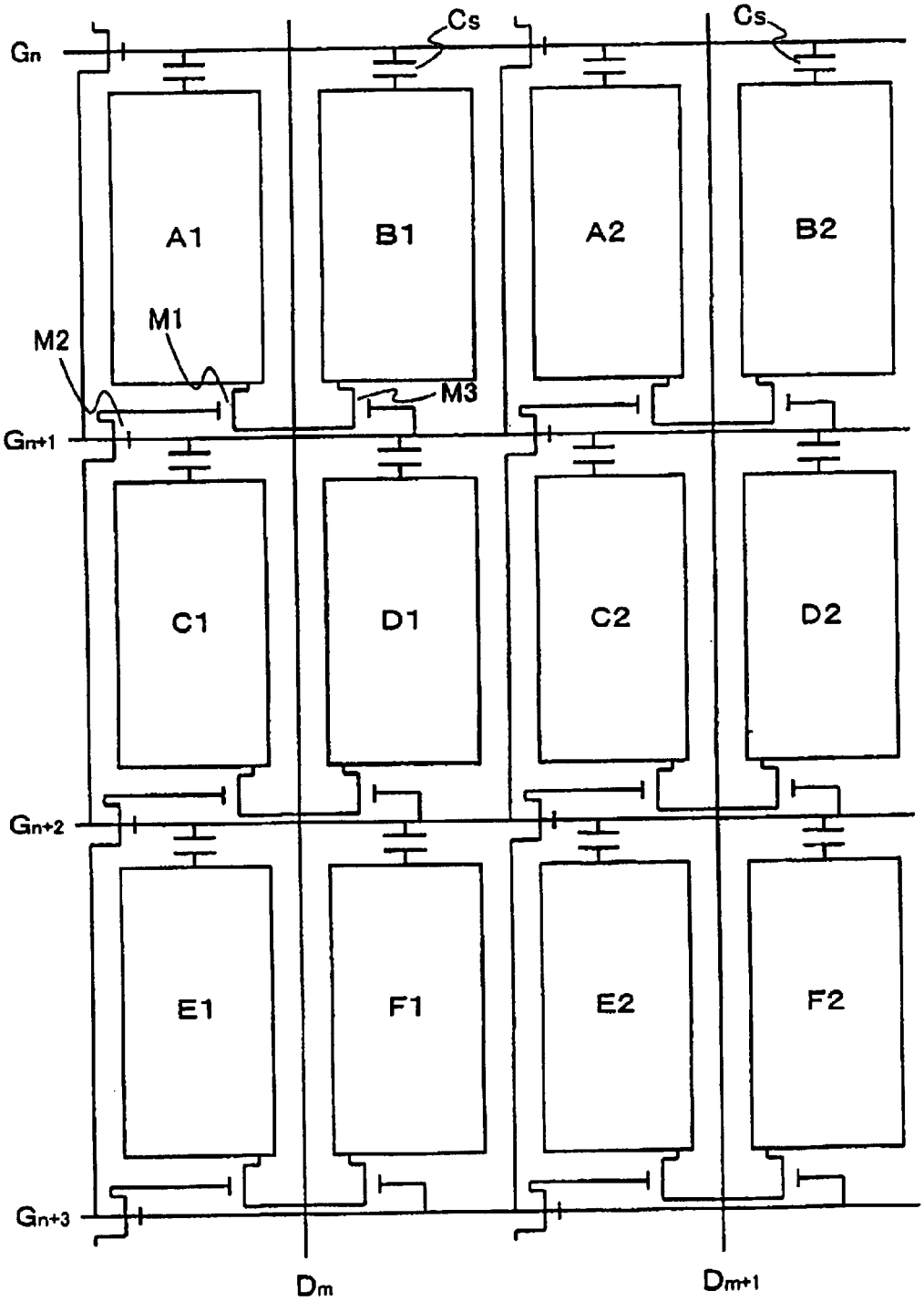
FIG. 2 is a view showing a circuit configuration of a display area 2 of an array substrate 1 according to a first embodiment.
Figure 5:
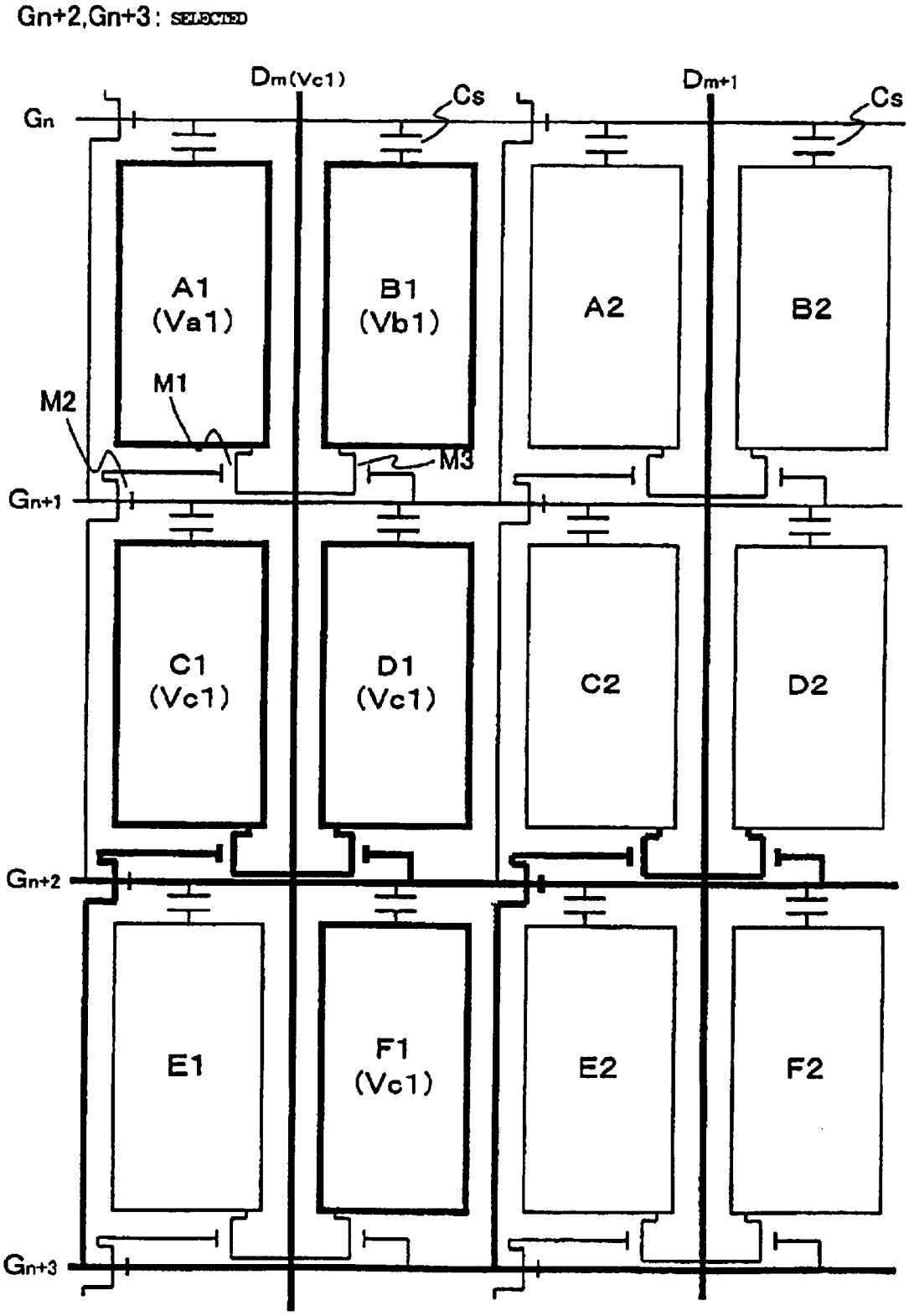
FIG. 5 is a view showing an operation of the array substrate 1 of the liquid crystal display apparatus according to the first embodiment.
Figure 6:
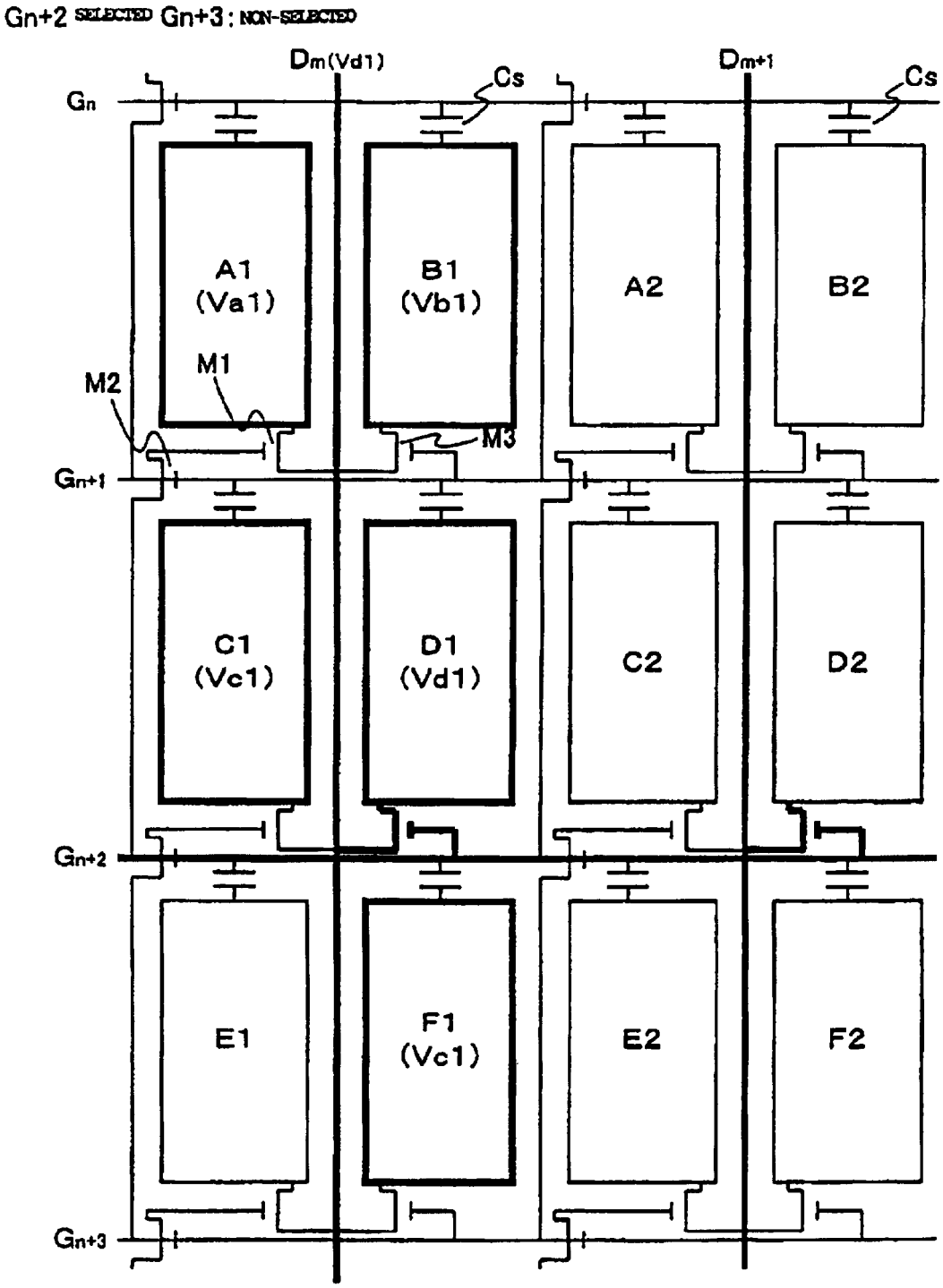
FIG. 6 is a view showing an operation of the array substrate 1 of the liquid crystal display apparatus according to the first embodiment.
Figure 7:
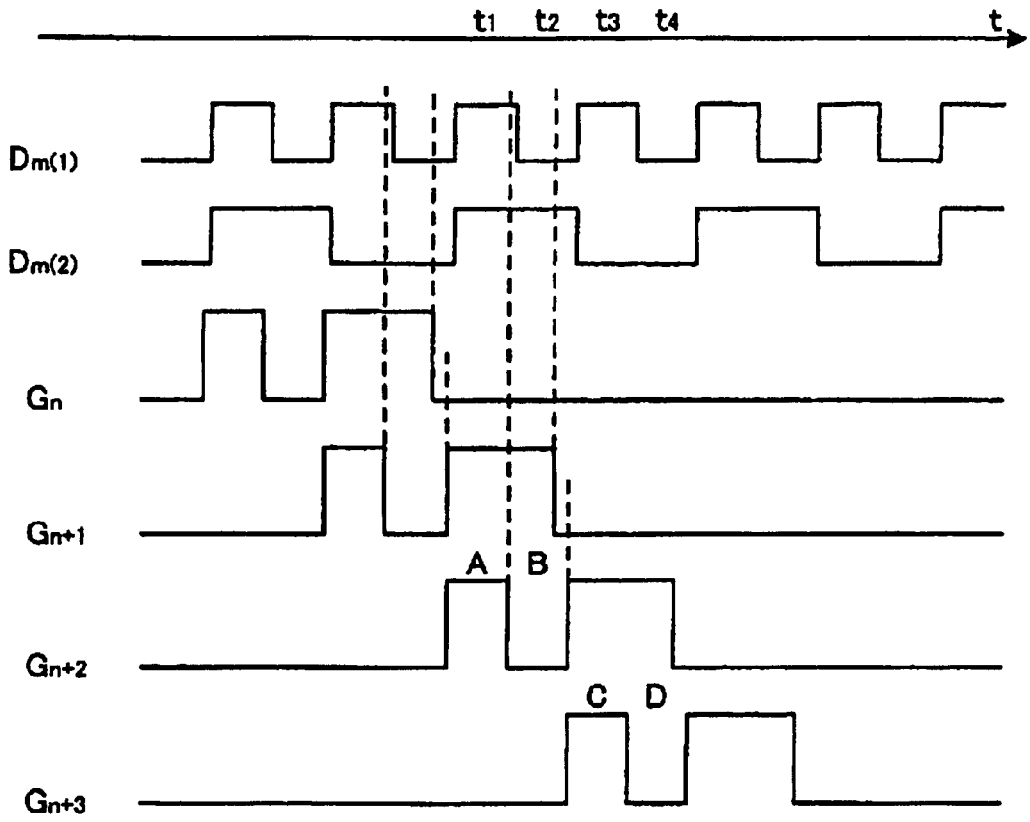
FIG. 7 is a timing chart of scan signals of the liquid crystal display apparatus according to the first embodiment.
Figure 8:
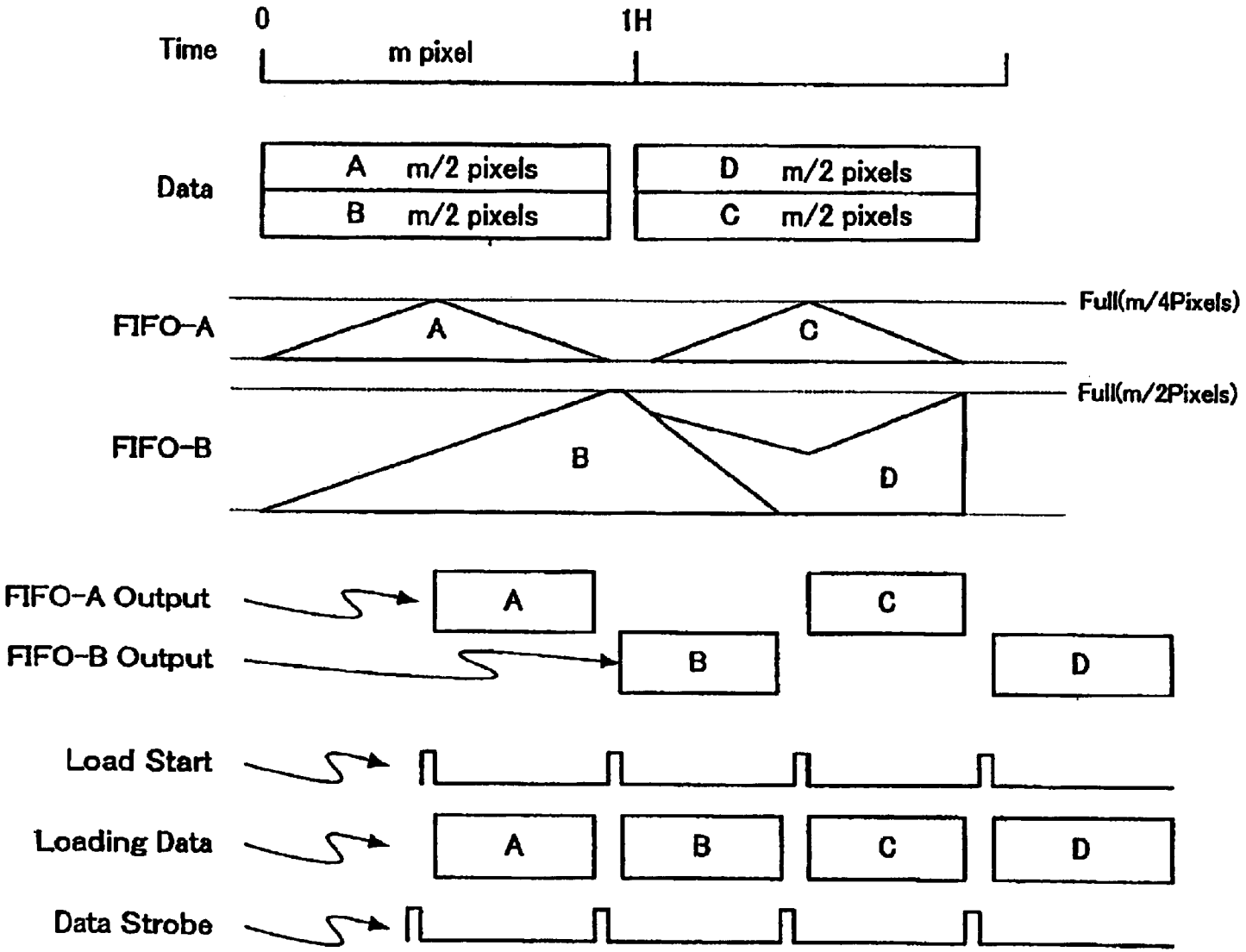
FIG. 8 is a timing chart of display signals of the liquid crystal display apparatus according to the first embodiment.

FIG. 1 is a schematic view showing a principal configuration of an array substrate 1 as an image display device according to this embodiment, FIG. 2 is a view showing a circuit configuration of a display area 2, FIGS. 3 to 6 are views showing operations of display area 2, FIG. 7 is a timing chart of scan signals, and FIG. 8 is a timing chart of display signals.

The liquid crystal display apparatus according to this embodiment has a feature in that two pixels adjacent to each other sandwiching one common display signal line share the display signal line to reduce the number of display signal lines in half. Moreover, the liquid crystal display apparatus according to this embodiment has a feature to supply the display signal by use of two FIFO-A 52 and FIFO-B 53 to be described later. As a matter of course, it is necessary for the liquid crystal display apparatus to include other elements such as a color filter substrate, which constitutes display area 2 and faces array substrate 1 each other, and a backlight unit. However, since these are not feature portions of the present invention, description thereof will be omitted.

As shown in FIG. 1, array substrate 1 includes an X driver 3 as a drive circuit for supplying display signals to pixel electrodes arranged in display area 2 through display signal lines 30, that is, for applying voltages thereto, and a Y driver 4 as a drive circuit for supplying scan signals controlling on/off of thin film transistors (TFT) through scan signal lines 40. In display area 2 of the array substrate 1, pixels in number of m'n are arrayed in a matrix. Here, m and n are any positive integers. X driver 3 is divided into five drivers 32 to 36, each corresponding to a specified number of display signal lines 30. Similarly, Y driver 4 is divided into five drivers 42 to 46, each corresponding to a specified number of scan signal lines 40. Note that the number five is only an example, and it is needless to say that other divisional numbers can be adopted.

X driver 3 and Y driver 4 are connected to a signal control circuit 5. Signal control circuit 5 controls drives of X driver 3 and Y driver 4 upon receiving digital video data (hereinafter referred to as video data) as display signals, synchronization signals (Sync) and clock signals (Clock) from a side of a host, such as a personal computer. Signal control circuit 5 includes an input memory controller 51, FIFO-A 52 as a first storage device, FIFO-B 53 as a second memory device, an output memory controller 54, and XY timing generator 55. FIFO-A 52 and FIFO-B 53 are memories, each having a First-in First-out function. As far as FIFO-A 52 and FIFO-B 53 are provided with this function, a concrete structure thereof does not become a problem. A signal processing circuit of the present invention is constituted of individuals or combinations of X driver 3, Y driver 4 and signal control circuit 5. Upon receiving the video data, input memory controller 51 controls as to which of FIFO-A 52 and FIFO-B 53 is to be a transfer destination of the received data and controls a transfer timing.

FIFO-A 52 and FIFO-B 53 store the video data transferred from input memory controller 51 one by one. The stored video data is outputted to output memory controller 54 based on the control of input memory controller 51 or output memory controller 54.

Output memory controller 54 executes a control as to which video data stored in FIFO-A 52 of FIFO-B 53 is to be read out and supplied to X driver 3. Output memory controller 54 also controls the timing when the video data is supplied to X driver 3.

The supplied video data based on the operation of output memory controller 54 is transferred to X driver 3 through data bus 31. While the video data is supplied to the respective drivers 32 to 36 constituting X driver 3, one of drivers 32 to 36 to which the supplied video data is actually inputted is determined by an X timing pulse (X DIO) outputted from XY timing generator 55 to X driver 3.

As described above, XY timing generator 55 generates the X timing pulse instructing which of drivers 32 to 36 is used for processing the video data transferred to data bus 31. Moreover, the XY timing generator 55 supplies signals controlling on/off of the thin film transistors to Y driver 4. The XY timing generator 55 generates a Y timing pulse (Y DIO) instructing which of drivers 42 to 46 of Y driver 4 is distributed with this on/off control signal. This Y timing pulse is supplied to Y driver 4.

As described above, this embodiment is characterized in that the two memories of FIFO-A 52 and FIFO-B 53 are provided in signal control circuit 5. Description will be made in detail later for specific contents of a video data supply method using these two memories.

FIG. 2 is a view showing a circuit structure in the display area 2. Note that FIG. 2 only shows a part of the display area 2 and a circuit having the structure shown in FIG. 2 is continuously formed in the actual display area 2. In FIG. 2, with regard to pixel electrodes A1 and B1 adjacent to each other sandwiching a display signal line Dm, three TFTs, that is, a first TFT M1, a second TFT M2 and a third TFT M3, are arranged in a manner as below.

First, with regard to first TFT M1, a source electrode thereof is connected to the display signal line Dm, and a drain electrode thereof is connected to pixel electrode A1. Moreover, a gate electrode of first TFT M1 is connected to a source electrode of second TFT M2. Here, the TFT is a three-terminal switching device. In the liquid crystal display apparatus, there is an example where an electrode connected to the display signal line is referred to as the source electrode and an electrode connected to the pixel electrode is referred to as the drain electrode, and there is an example inverse thereto. Specifically, determination has not been uniquely made as to which of two electrodes except the gate electrode is to be referred to as the source electrode or the drain electrode. Accordingly, each of the two electrodes except the gate electrode will be referred to as a source/drain electrode hereinafter.

Next, with regard to second TFT M2, a source/drain electrode thereof is connected to the gate electrode of first TFT M1, and another source/drain electrode is connected to a scan signal line Gn+2.

Accordingly, the gate electrode of first TFT M1 is connected to scan signal line Gn+2 through second TFT M2. Moreover, the gate electrode of second TFT M2 is connected to scan signal line Gn+1. Hence, only during a period when two scan signal lines Gn+1 and Gn+2 adjacent to each other are simultaneously at a selected potential, first TFT M1 is turned on, and a potential of display signal line Dm is supplied to pixel electrode A1. This suggests that second TFT M2 controls on/off of first TFT M1.

With regard to third TFT M3, a source/drain electrode is connected to display signal line Dm, and another source/drain electrode is connected to pixel electrode B1. Moreover, a gate electrode of third TFT M3 is connected to scan signal line Gn+1. Accordingly, when scan signal line Gn+1 is at the selected potential, third TFT M3 is turned on, and the potential of the display signal line Dm is supplied to pixel electrode B1.

Description has been made above for the circuit configuration in display area 2 seen from first TFT M1 to third TFT M3. Now, description will be made for the circuit configuration in display area 2 seen from pixel electrode A1 and pixel electrode B1.

To pixel electrode A1 and pixel electrode B1, the display signals are supplied from the common and single display signal line Dm. Specifically, the display signal line Dm can be said to be the display signal line Dm common to pixel electrode A1 and pixel electrode B1. Hence, while the pixels are arrayed in an M'N matrix, the number of the display signal lines Dm will be M/2. To pixel electrode A1, first TFT M1 and second TFT M2 are connected, first TFT M1 is connected to display signal line Dm and second TFT M2. The gate electrode of the second TFT M2 is connected to scan signal line Gn+1 downstream of pixel electrode A1, and the drain electrode of second TFT M2 is connected to scan signal line Gn+2 downstream of scan signal line Gn+1. Here, in order to supply the potential of display signal line Dm to pixel electrode A1, it is necessary to turn on first TFT M1. Moreover, the gate electrode of first TFT M1 is connected to one source/drain electrode of second TFT M2, the gate electrode of second TFT M2 is connected to scan signal line Gn+1 of its own, and the other source/drain electrode thereof is connected to scan signal line Gn+2 downstream of pixel electrode A1. Therefore, in order to turn on first TFT M1, it is necessary to turn on second TFT M2. In order to turn on second TFT M2, it is necessary that scan signal line Gn+1 be selected. During this selection period, when scan signal line Gn+2 is selected, first TFT M1 is also turned on. Hence, first TFT M1 and second TFT M2 constitute a switching mechanism, which allows the scan signals to pass therethrough when both scan signal line Gn+1 and scan signal line Gn+2 are selected. Accordingly, pixel electrode A1 is driven based on the scan signal from scan signal line Gn+1 and the scan signal from scan signal line Gn+2, and receives the potential from display signal line Dm.

To pixel electrode B1, third TFT M3 is connected, and a gate electrode thereof is connected to scan signal line Gn+1. Hence, pixel electrode B1 is supplied with the potential from display signal line Dm when scan signal line Gn+1 of its own is selected.

Description has been made above for pixel electrode A1 and pixel electrode B1, however, pixel electrode A2 and pixel electrode B2, pixel electrode C1 and pixel electrode D1, pixel electrode C2 and pixel electrode D2, and other pixel electrodes are configured similarly.

Next, description will be made for operations of pixel electrode A1 to pixel electrode D1 depending on selection and non-selection of scan signal lines Gn+1 to Gn+3 with reference to circuit diagrams of FIGS. 3 to 6 and the timing chart of the scan signals shown in FIG. 7.

Dm(1) and Dm(2) shown in FIG. 7 are potentials of data signals supplied by display signal line Dm and show timings when the data signals are changed. These Dm(1) and Dm(2) include changes of polarities and gray-scales. Accordingly, if the changes are grasped as changes of the polarities, in the case of an operation by Dm(1), the polarities of pixel electrode A1 and pixel electrode B1 become different from each other, and the polarities of pixel electrode A1 and pixel electrode C1 become the same. Meanwhile, in the case of an operation by Dm (2), the polarities of pixel electrode A1 and pixel electrode B1 become the same, and the polarities of pixel electrode A1 and pixel electrode C1 become different from each other.

Moreover, in FIG. 7, diagrams of scan signal lines Gn to Gn+3 show the selection and the non-selection of scan signal lines Gn to Gn+3. Specifically, each portion where the diagram rises shows a state where the concerned scan signal line is selected, and each portion not corresponding to the above shows a state where the concerned scan signal line is not selected.

Figure 3:
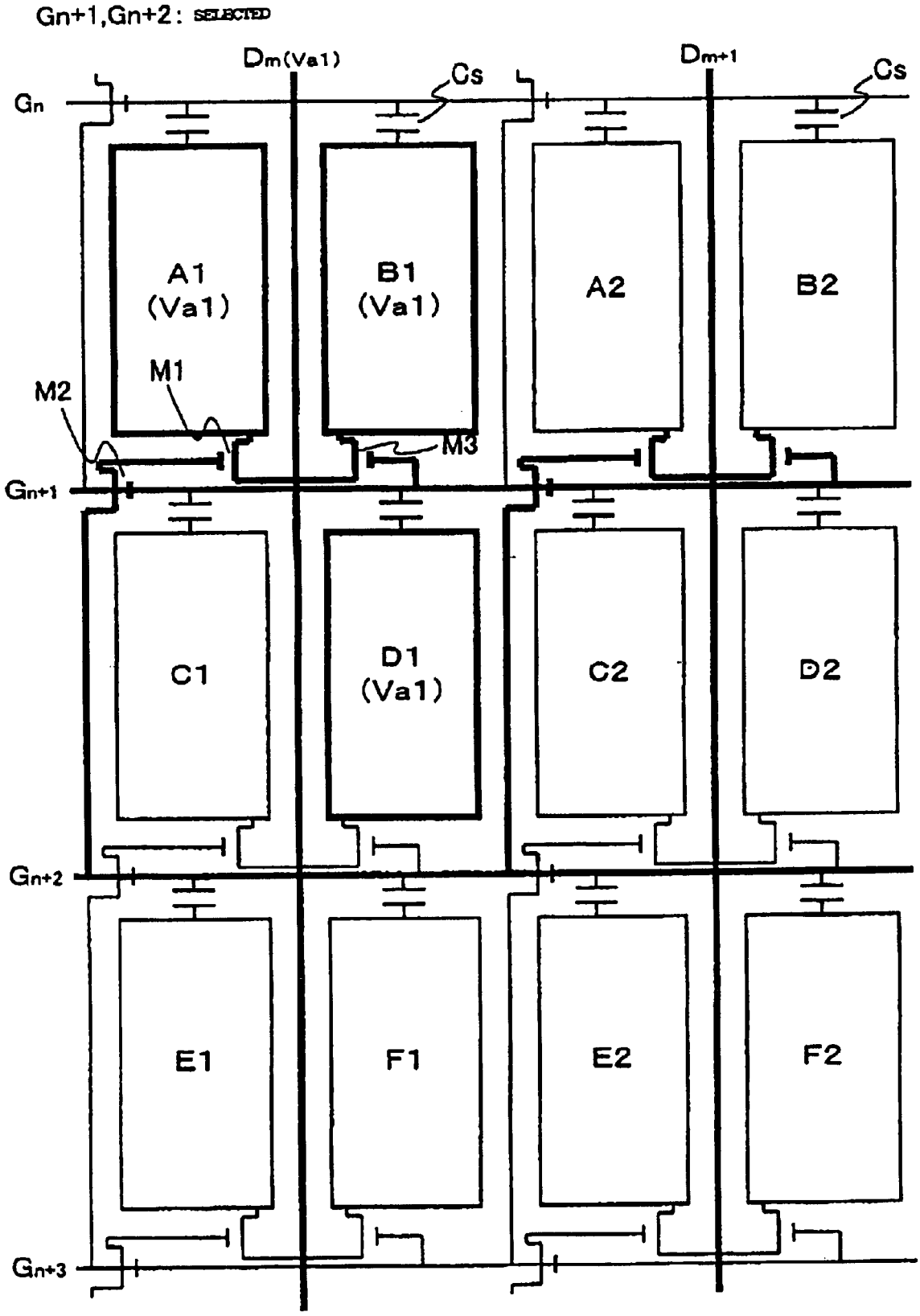
FIG. 3 is a view showing an operation of the array substrate 1 of the liquid crystal display apparatus according to the first embodiment.

As shown in FIG. 3 and FIG. 7, during a period (t1) from a time when both scan signal line Gn+1 and scan signal line Gn+2 are selected to a time when scan signal line Gn+2 falls to the non-selection potential, first TFT M1 to third TFT M3 is turned on. Note that, in FIG. 3, the selection of scan signal line Gn+1 and scan signal line Gn+2 is indicated by bold lines of the concerned diagrams. As shown in FIG. 3, a potential Va1 to be applied to pixel electrode A1 from display signal line Dm is supplied to pixel electrode A1, pixel electrode B1 and pixel electrode D1. Here, the potential Va1 of pixel electrode A1 is determined.

After scan signal lines Gn+2 falls to the non-selection potential, the potential supplied from display signal line Dm is changed to a potential Vb1 to be applied to pixel electrode B1.

Figure 4:
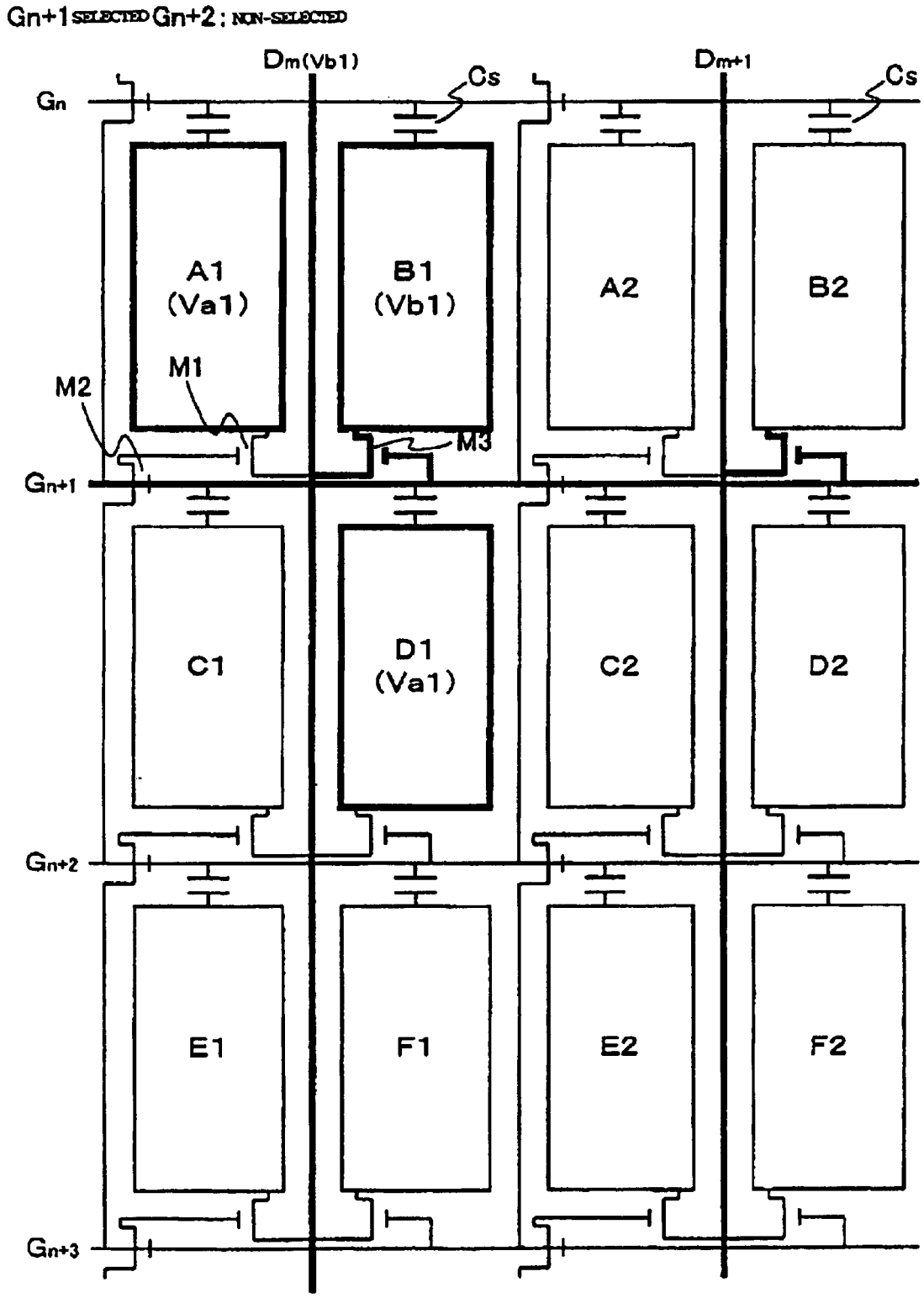
FIG. 4 is a view showing an operation of the array substrate 1 of the liquid crystal display apparatus according to the first embodiment.

As shown in FIG. 7, scan signal line Gn+1 is still set at the selection potential during period (t2) after scan signal line Gn+2 falls to the non-selection potential, whereby, as shown in FIG. 4, the potential Vb1 is supplied to pixel electrode B1, and the potential of pixel electrode B1 is determined. As described above, the potential of display signal line Dm is supplied to pixel electrode A1 and pixel electrode B1 in time division.

After scan signal line Gn+1 falls to the non-selection potential, the potential of display signal line Dm is changed to a potential Vc1 to be applied to pixel electrode C1.

Moreover, as shown in FIG. 7, when scan signal line Gn+2 rises again to the selection potential and scan signal line Gn+3 rises to the selection potential during a period (t3) after scan signal line Gn+1 falls to the non-selection potential, as shown in FIG. 5, the potential Vc1 is supplied to pixel electrode C1, pixel electrode D1 and pixel electrode F1. Here, the potential Vc1 of pixel electrode C1 is determined.

After scan signal line Gn+3 falls to the non-selection potential, the potential supplied from display signal line Dm is changed to a potential Vd1 to be applied to pixel electrode D1.

As shown in FIG. 7, scan signal line Gn+2 is still set at the selection potential during a period (t4) after scan signal line Gn+3 falls to the non-selection potential, whereby, as shown in FIG. 6, the potential Vd1 is supplied to pixel electrode D1, and the potential of pixel electrode D1 is determined.

The liquid crystal display apparatus of the first embodiment adopts the configuration of supplying a drive potential from one display signal line, for example, from display signal line Dm to two pixel electrodes A1 and B1 adjacent to each other sandwiching the display signal line. Accordingly, as compared with the conventional liquid crystal display apparatus, in which the pixels and the display signal lines correspond to each other one by one, the number of the display signal lines, that is, the number of data drivers can be reduced in half. Furthermore, in the liquid crystal display apparatus according to the first embodiment, the first TFT M1 connected to pixel electrode A1 and the second TFT M2 connected to pixel electrode B1 are directly connected to common display signal line Dm. Accordingly, unlike a circuit configuration disclosed in the gazette of Japanese Patent Laid-Open No. Hei 5 (1993)-265045, in which two TFTs are connected in series between the display signal line and the pixel electrode, it is not necessary to design the TFT to be large in order to secure a desired current. Specifically, according to the first embodiment, as compared with the liquid crystal display apparatus disclosed in the gazette of Japanese Patent Laid-Open No. Hei 5 (1993)-265045, the first TFT M1 and the second TFT M2 as the switching devices can be made to be small in dimension.

In the liquid crystal display apparatus according to the first embodiment, storage capacitors Cs are provided between the pixels and the scan signal lines upstream thereof. Specifically, as shown in FIG. 2, storage capacitors Cs of pixel electrodes A1, B1, A2 and B2 are provided between the concerned pixel electrodes and the scan signal line Gn, and storage capacitors Cs of pixel electrode C1, D1, C2 and D2 are provided between the concerned pixel electrodes and scan signal line Gn+1. Scan signal line Gn is not involved in the drives of pixel electrodes A1, B1, A2 and B2, and scan signal line Gn+1 is not involved in the drives of pixel electrodes C1, D1, C2 and D2. Here, during the period when the potentials are supplied from display signal lines Dm and Dm+1 to pixel electrodes A1, B1, A2 and B2 and immediately after the period, the potential of scan signal line Gn is not varied. Accordingly, variations of the pixel potentials in pixel electrodes A1, B1, A2 and B2 are avoided, which implies that the pixel potentials can be controlled accurately. This becomes a greatly advantageous point on image quality, and a high-quality image can be thereby provided. This feature of the embodiment in that the storage capacitors Cs can be provided between the pixel electrodes and the scan signal line upstream thereof can be enjoyed even if two TFTs are connected in series between the display signal lines and the pixels.

Here, when the storage capacitors are disposed between the pixels and the scan signal line upstream thereof, the potential of the scan signal line upstream thereof will be varied during the period when the potentials are supplied from the display signal line to the concerned pixels, therefore, the potentials of the concerned pixels will be varied.

In order to avoid the variation of the pixel potentials, an aspect is not adopted, in which parts of the scan signal line are used as the storage capacitors, but independent storage capacitors may be formed. However, formation of the independent storage capacitors causes an aperture ratio of the pixels to be lowered. Moreover, in some cases, it may be also necessary to change or add a process for preparing the array substrate. Accordingly, the first embodiment can be said to be desirable from a viewpoint of the aperture ratio and the manufacturing process. As a matter of course, the present invention does not deny the formation of the independent storage capacitors Cs.

Incidentally, the liquid crystal display apparatus according to this embodiment is characterized in a supply method of video data inputted thereto to X driver 3. Hereinafter, description will be made for this characteristic supply method of video data with reference to FIG. 8.

FIG. 8 is a timing chart showing video data (Data) inputted to the liquid crystal display apparatus, storing states of the data in FIFO-A 52 and FIFO-B 53, outputting states of the data from FIFO-A 52 and FIFO-B 53, and the data supplied to X driver 3 in contrast to a horizontal cycle.

In FIG. 8, "1H" put to a row diagram denoted by Time denotes one horizontal cycle. Now, it is assumed that m pieces of pixels are arrayed in the horizontal direction of display area 2. "m pixel" shown in the diagram of Time indicates that the m pieces of pixels are arrayed in the horizontal direction and that the display signals are supplied to the m pieces of pixels arrayed in the same row in the one horizontal cycle.

Now, when the first horizontal cycle is started, the video data is inputted to signal control circuit 5 from a host. Here, it is assumed that the video data for a row where pixel electrodes A1, B1, A2, B2 are arrayed, and for a row where pixel electrodes C1, D1, C2, D2 are arrayed in FIG. 2 is inputted.

The video data to the row where pixel electrodes A1, B1, A2, B2 are arrayed is inputted during the first horizontal cycle, and the video data to the row where pixel electrodes C1, D1, C2, D2 are arrayed is inputted during the next one horizontal cycle. This state is schematically shown in rows of "Data" of FIG. 8. The video data inputted during the first horizontal cycle is supplied from the host in order of video data to be supplied to pixel electrode A1, video data to be supplied to pixel electrode B1, video data to be supplied to pixel electrode A2, and video data to be supplied to pixel electrode B2. When the video data to be supplied to pixel electrodes A1, A2, A3, A4 is defined as A, and when the video data to be supplied to pixel electrodes B1, B2, B3, B4 is defined as B, data for the m pieces of pixels in total, which is obtained by adding the video data A for m/2 pieces of pixels to video data B for m/2 pieces of pixels, is inputted to signal control circuit 5 during the first horizontal cycle.

The inputting operation is also executed in the next one horizontal cycle (hereinafter referred to as second horizontal cycle) similarly to the above. Specifically, the video data is supplied from the host in order of the video data to be supplied to pixel electrode C1, the video data to be supplied to pixel electrode D1, and the video data to be supplied to pixel electrode C2. Then, when the video data to be supplied to pixel electrodes C1, C2, C3, C4 is defined as C, and when the video data to be supplied to pixel electrodes D1, D2, D3, D4 is defined as D, data for the m pieces of pixels in total, which is obtained by adding video data C for m/2 pieces of pixels to video data D for m/2 pieces of pixels, is inputted to signal control circuit 5 during the second horizontal cycle.

The video data inputted to signal control circuit 5 is distributed to FIFO-A 52 and FIFO-B 53 by input memory controller 51. In this embodiment, video data A and C are distributed to FIFO-A 52, and video data B and D are distributed to FIFO-B 53.

FIFO-A 52 has a capacity of storing data for m/4 pieces of pixels, and FIFO-B 53 has a capacity of storing data for m/2 pieces of pixels. The data for m/4 pieces of pixels has a volume corresponding to the ½ of the horizontal cycle of video data A (C), and the data for m/2 pieces of pixels has a volume corresponding to the one horizontal cycle of video data B (D). In diagrams of the storing state of the data in rows of "FIFO-A" and "FIFO-B", Full (m/4 pixel) and Full (m/2 pixel) indicate the data storage capacities of FIFO-A 52 and FIFO-B 53.

During the first horizontal cycle, video data A is stored in FIFO-A 52, and video data B is stored in FIFO-B 53. Storage amounts of video data A and video data B in FIFO-A 52 and FIFO-B 53 are linearly increased as shown in FIG. 8.

In FIFO-A 52, when FIFO-A 52 is filled with video data A sequentially inputted thereto, video data A is outputted from FIFO-A 52 by the First-in First-out function. A rate at which video data A is outputted from FIFO-A 52 is twice as rapid as a rate at which video data A is inputted to FIFO-A 52. Accordingly, as shown in the row of "FIFO-A" of FIG. 8, after FIFO-A 52 is filled with video data A, the data storage amount in FIFO-A 52 is linearly decreased. During this period, as shown in a row of "FIFO-A Output" of FIG. 8, video data A is continuously outputted from FIFO-A 52. Video data A is outputted from FIFO-A 52 at the sign of a supply start signal (Load Start in FIG. 8) generated in output memory controller 54, and is held within X driver 3 by an instruction of a data strobe signal (Data Strobe in FIG. 8) generated in output memory controller 54, then is outputted from display signal lines 30 as the pixel signals (Loading Data in FIG. 8).

In FIFO-B 53, when FIFO-B 53 is filled with video data B sequentially inputted thereto, video data B is outputted from FIFO-B 53 by the First-in First-out function. Here, a point different from FIFO-A 52 is that an output start timing of video data B from FIFO-B 53 is delayed since the data storage capacity of FIFO-B 53 is larger than that of FIFO-A 52. As shown in the row of "FIFO-B" of FIG. 8, after video data B of an amount corresponding to that for m/2 pixels, that is, for one horizontal cycle, is stored in FIFO-B 53, the output of video data B from FIFO-B 53 is started by the instruction of the supply start signal (Load Start). Then, the data storage amount in FIFO-B 53 is linearly decreased. During this period, as shown in the section of the "FIFO-B Output" of FIG. 8, video data B is continuously outputted from FIFO-B 53. Video data B outputted from FIFO-B 53 is held within X driver 3 at the sign of the data strobe signal (Data Strobe in FIG. 8), and then outputted as the pixel signals through display signal lines 30.

During the second horizontal cycle, video data C is stored in FIFO-A 52, and video data D is stored in FIFO-B 53.

As shown in FIG. 8, video data A is entirely outputted from FIFO-A 52 at a point of time when video data C is inputted to signal control circuit 5. Accordingly, video data C is supplied to X driver 3 through a process similar to that of video data A in the first horizontal cycle.

At a point of time when video data D is inputted to signal control circuit 5, video data B remains in FIFO-B 53. Accordingly, there is a period when both video data B and video data D are stored in FIFO-B 53. When video data B is entirely outputted from FIFO-B 53, and when video data C is entirely outputted from FIFO-A 52, video data D is outputted from FIFO-B 53 at the sign of the supply start signal (Load Start in FIG. 8). Supply of video data C and video data D to X driver 3 is executed similarly to the case of video data A and video data B.

Although description has been made above for video data A to D, similar operations are executed for other pixels E, F as described above, according to the first embodiment, even if the storage capacity of FIFO-A 52 is reduced in half of FIFO-B 53, the supply of the display signals free from troubles can be realized by optimizing the timing of the data input from the outside and the timing of the data output thereto.

More specific contents of the timings will be described as below. Specifically, with regard to video data A and video data B, which have been inputted from the outside during the first horizontal cycle, video data A stored in FIFO-A 52 is outputted prior to video data B stored in FIFO-B 53. Moreover, video data A is stored in FIFO-A 52 during the first horizontal cycle, video data B is stored in FIFO-B 53, and video data A stored in FIFO-A 52 is outputted during the first horizontal cycle. Then, during the second horizontal cycle following the first horizontal cycle, the output of video data B stored in FIFO-B 53 during the first horizontal cycle is completed. In this case, the output of video data A from FIFO-A 52 and the output of video data B from FIFO-B 53 are completed during one horizontal cycle. Moreover, in the above first embodiment, description has been made for the example where two pixel electrodes are connected to common display signal line 30, however, this embodiment can be applied to a display apparatus having a pixel structure where display signal line 30 common to three or more of the pixel electrodes is connected thereto while adjusting a balance of the storage capacities.

In the first embodiment, description has been made for the example where FIFO-A 52 and FIFO-B 53 are provided in signal control circuit 5 supplying the video data to X driver 3. However, it is also possible to provide functions of two FIFOs, that is, FIFO-A 52 and FIFO-B 53 in X driver 3. The second embodiment is where the functions of FIFO-A 52 and FIFO-B 53 are imparted into X driver 3.

Figure 9:
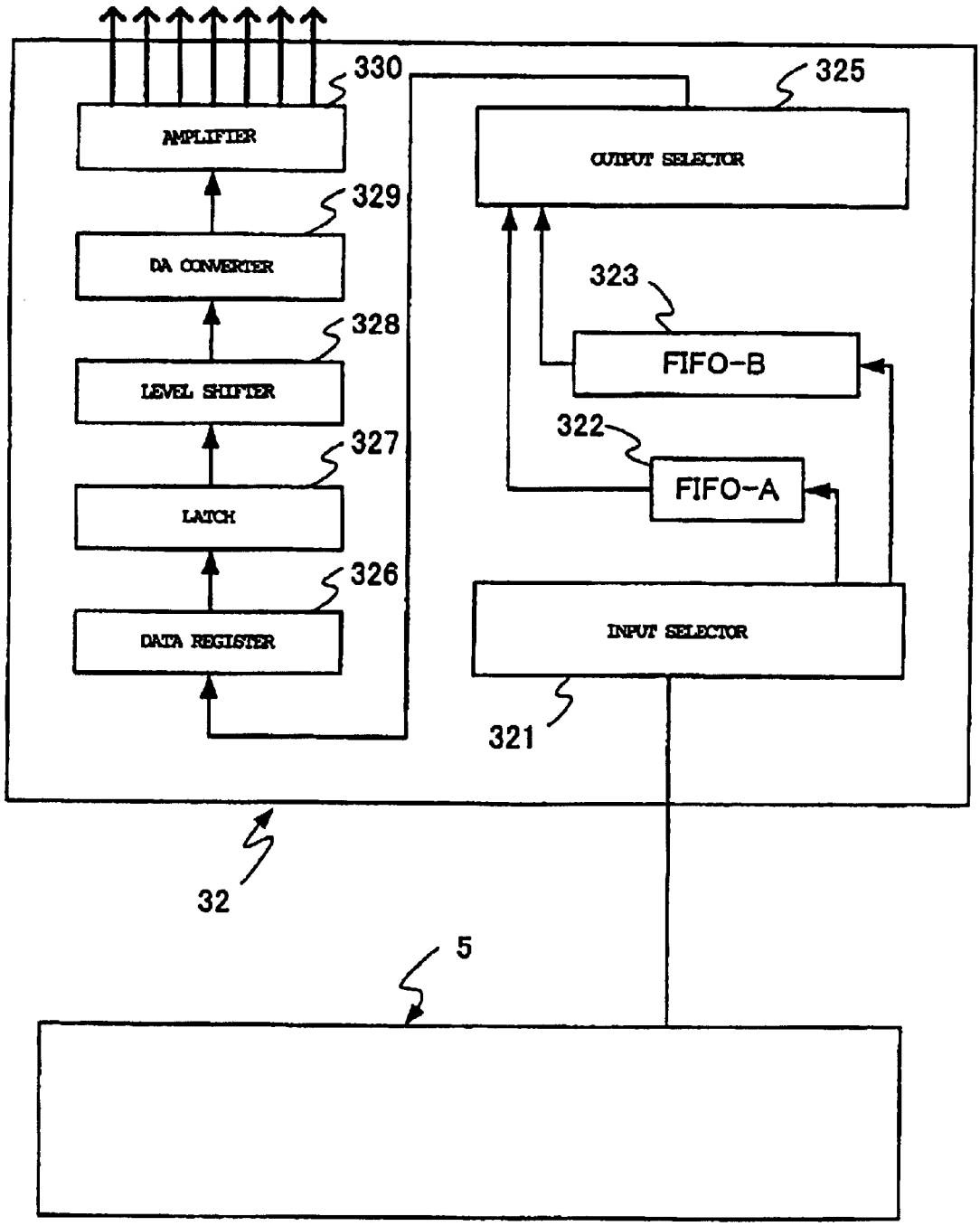
FIG. 9 is a view showing a configuration of a driver 32 of the liquid crystal display apparatus according to a second embodiment.

FIG. 9 is a view showing a configuration of driver 32 in the second embodiment. Note that, in the second embodiment, each of drivers 33 to 36 has a configuration similar to that of driver 32.

As shown in FIG. 9, driver 32 includes an input selector 321, a FIFO-A 322, a FIFO-B 323, an output selector 325, a data register 326, a latch 327, a level shifter 328, a digital/analog (DA) converter 329, and an amplifier 330.

Input selector 321 controls as to which of FIFO-A 322 and FIFO-B 323 is to be a transfer destination of video data sent from signal control circuit 5 and controls a transfer timing.

FIFO-A 322 and FIFO-B 323 sequentially store the video data transferred from input selector 321. The stored video data is outputted to data register 326 based on control of output selector 325.

Output selector 325 reads out the video data stored in any of FIFO-A 322 and FIFO-B 323, and supplies the read-out data to data register 326. Output selector 325 also controls a supply timing of the video data to data register 326.

The video data stored in data register 326 is transferred to latch 327 at the sign of a strobe signal sent from signal control circuit 5. A voltage of the video data transferred to latch 327 is converted, for example, from 3.3 V to 8 V, by level shifter 328, and then the video data is supplied to DA converter 329. The video data subjected to conversion from digital signals to analog signals by DA converter 329 is amplified to a specified value by amplifier 330, and then the video data (the analog signals) is outputted as display signals to the respective display signal lines 30.

Assuming that, for example, ma/2 pieces of display signal lines 30 are connected to driver 32 shown in FIG. 9, then driver 32 supplies the display signals corresponding to ma/2 pieces of pixels.

Similarly to the first embodiment, the video data is inputted to signal control circuit 5 from a host in order of reference codes A1, B1, A2, B2, A3, B3, and in the same order, is inputted to driver 32. Hereinafter, description will be made for a supply method of video data in the second embodiment with reference to FIG. 10.

Figure 10:
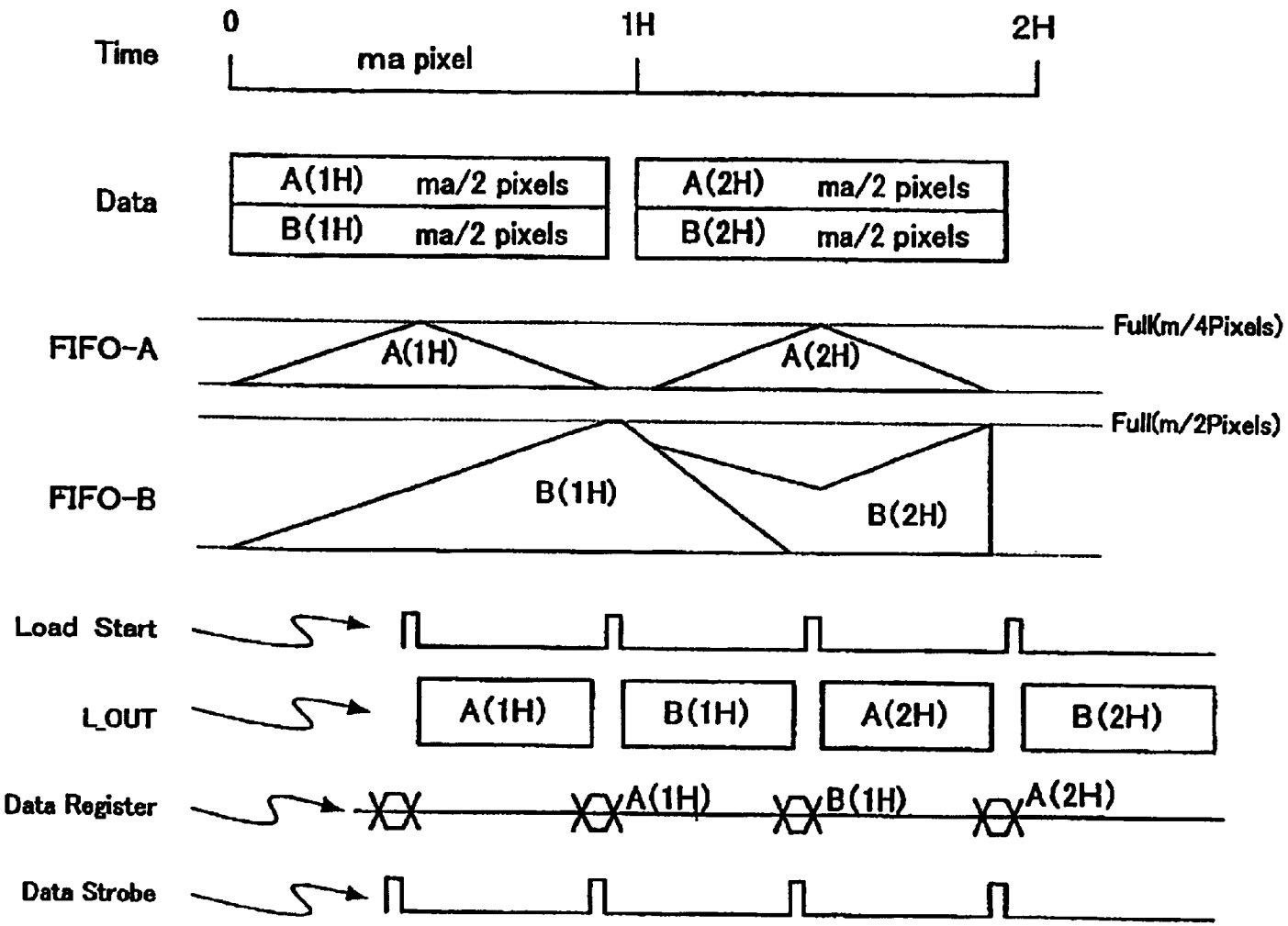
FIG. 10 is a timing chart of the display signals of the liquid crystal display apparatus according to the second embodiment.

FIG. 10 is a timing chart showing video data inputted to the liquid crystal display apparatus, storing states of the data in FIFO-A 322 and FIFO-B 323, outputting states of the data from FIFO-A 322 and FIFO-B 323, the data supplied from output selector 325 to data register 326, and supply states of the video data in data register 326 in contrast to the horizontal cycle. Now, it is assumed that video data for a row where pixel electrodes A1, B1, A2, B2 are arrayed is inputted. Moreover, in FIG. 10, reference codes A1, B1, A2 and B2 denote the video data corresponding to the pixel electrodes having the same reference codes.

As shown in FIG. 10, driver 32 receives video data A(1H) and B(1H) from signal control circuit 5 during the first horizontal cycle. During the second horizontal cycle, driver 32 receives video data A(2H) and B(2H). Note that in FIG. 10, "1H" of reference code A(1H) implies the first horizontal cycle, and "2H" of reference code A(2H) implies the second horizontal cycle.

The video data inputted to driver 32 is distributed to FIFO-A 322 and FIFO-B 323 by input selector 321. In this embodiment, video data A(1H), A(2H) are distributed to FIFO-A 322, and video data B(1H), B(2H) are distributed to FIFO-B 323. The number of pixels connected to driver 32 is ma per one row, FIFO-A 322 is provided with a capacity for storing data for ma/4 pieces of pixels, and FIFO-B 323 is provided with a capacity for storing data for ma/2 pieces of pixels.

During the first horizontal cycle, video data A(1H) is stored in FIFO-A 322, and video data B(1H) is stored in FIFO-B 323.

In FIFO-A 322, when FIFO-A 322 is filled with video data A(1H) sequentially inputted thereto, video data A(1H) is outputted from FIFO-A 322 by the First-in First-out function. A rate at which video data A(1H) is outputted from FIFO-A 322 is twice as rapid as a rate at which video data A(1H) is inputted to FIFO-A 322. Accordingly, as shown in the row of "FIFO-A" of FIG. 10, after FIFO-A 322 is filled with video data A(1H), the data storage amount in FIFO-A 322 is linearly decreased. During this period, as shown in a row of "L_Out" of FIG. 10, video data A(1H) is supplied from FIFO-A 322 through output selector 325 to data register 326. Video data A(1H) is supplied to data register 326 at the sign of a supply start signal (Load Start in FIG. 10). After video data A(1H) is supplied to data register 326 for a specified period, video data A (1H) stored in data register 326 is transferred to latch 327 at the sign of a data strobe signal (Data Strobe in FIG. 10).

In FIFO-B 323, when FIFO-B 323 is filled with video data B(1H) inputted thereto, video data B(1H) is outputted from FIFO-B 323 by the First-in First-out function. Here, as shown in the row of "FIFO-B" of FIG. 10, after video data B(1H) for the m/2 pieces of pixels is stored in FIFO-B 323, the output of video data B(1H) from FIFO-B 323 is started by the instruction of the supply start signal (Load Start in FIG. 10). Thereafter, similarly to the case of FIFO-A 322, video data B(1H) is transferred to latch 327.

During the second horizontal cycle, video data A(2H) is stored in FIFO-A 322, and video data B(2H) is stored in FIFO-B 323.

As shown in FIG. 10, video data A(1H) is entirely outputted from FIFO-A 322 at a point of time when video data A(2H) is inputted to driver 32. Accordingly, video data A(2H) is supplied to latch 327 through a process similar to that of video data A(1H) in the first horizontal cycle.

At a point of time when video data B(2H) is inputted to driver 32, video data B(1H) remains in FIFO-B 323. Accordingly, there is a period when both of video data B(1H) and video data B(2H) are stored in FIFO-B 323. When video data B(1H) is entirely outputted from FIFO-B 323, and when video data A(2H) is entirely outputted from FIFO-A 322, video data B(2H) is outputted from FIFO-B 323 at the sign of the supply start signal (Load Start in FIG. 10). Supply of video data A(2H) and video data B(2H) to latch 327 is executed similarly to the case of video data A(1H) and video data B(1H).

Description has been made above for video data A1, A2, B1 and B2. In this embodiment, since driver 32 supplies the display signals to the pixels denoted by the codes A1 to Ama/2 and B1 to Bma/2, a similar operation is iterated in video data A3 and B3 and after. Moreover, also for drivers 33 to 36, the similar operation to that for driver 32 is executed.

As described above, the present invention can be realized also within X driver 3, while the invention can be realized in signal control circuit 5 as described in the first embodiment.

In the above-described second embodiment, the example has been shown, in which two FIFOs are provided within driver 32. In the third embodiment, description will be made for a modification example of the second embodiment.

Figure 11:
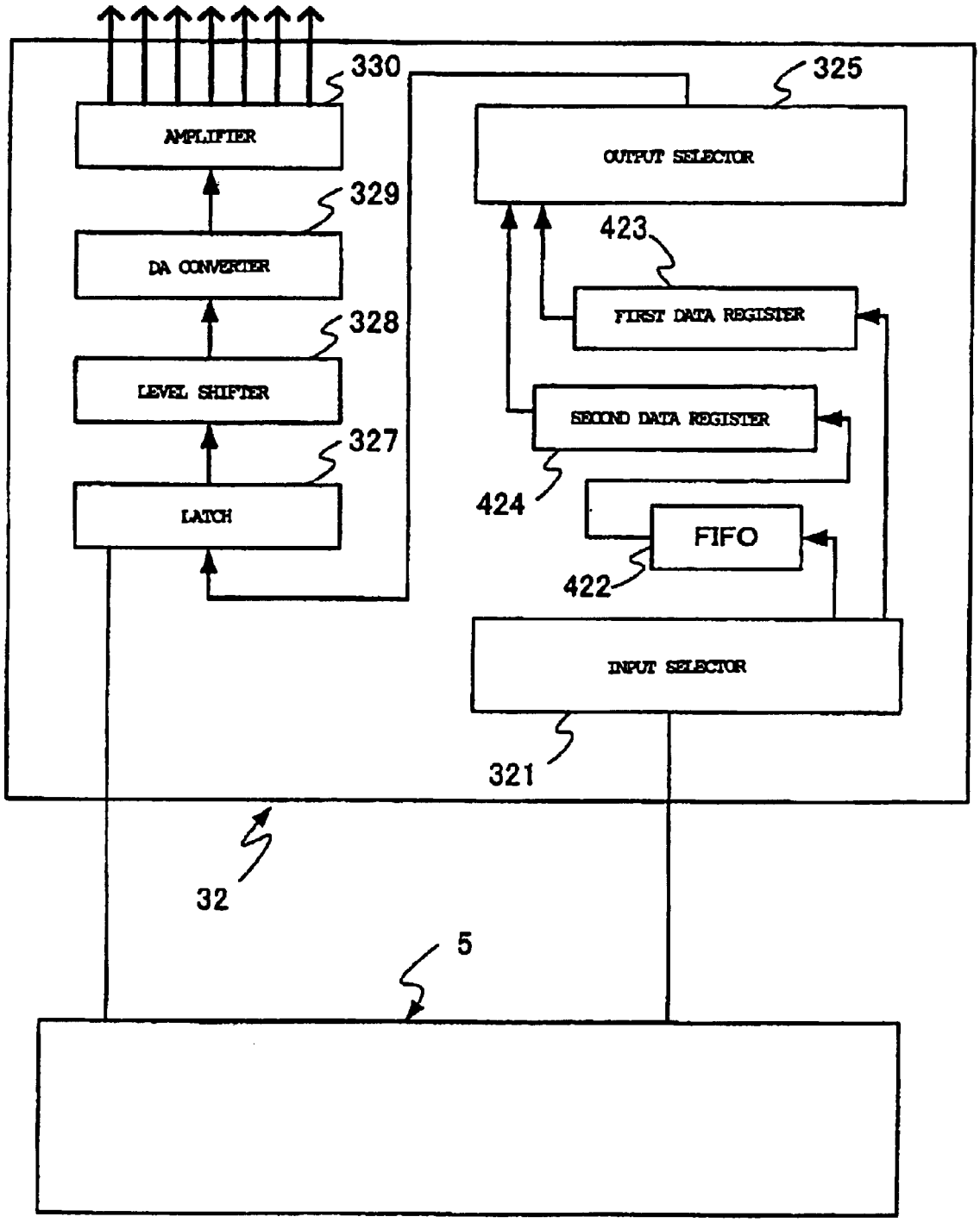
FIG. 11 is a view showing a configuration of the driver 32 of the liquid crystal display apparatus according to a third embodiment.

FIG. 11 is a view showing a configuration of driver 32 in the third embodiment.

In FIG. 11, driver 32 includes an input selector 321, a FIFO 422, a first data register 423, a second data register 424, an output selector 325, a latch 327, a level shifter 328, a DA converter 329, and an amplifier 330. As shown in FIG. 11, in the third embodiment, first data register 423 constitutes a first storage area, and FIFO 422 and the second data register constitute a second storage area.

Input selector 321 controls as to which of FIFO 422 and first data register 423 is to be a transfer destination of video data sent from signal control circuit 5 and controls a transfer timing.

FIFO 422 sequentially stores the video data transferred from input selector 321. The video data is stored in FIFO 422 until the storage capacity of FIFO 422 is filled therewith, and in response to an output request, the video data is outputted to second data register 424 from FIFO 422 in order of the transfer based on the First-in First-out function of FIFO 422. The storage capacity of FIFO 422 is ma/4.

First data register 423 stores the video data transferred from input selector 321. The video data stored in first data register 423 is transferred to output selector 325 based on the load signal sent from signal control circuit 5. First data register 423 has a storage capacity for ma/2 pieces of pixels.

Second data register 424 stores the video data transferred from FIFO 422. The video data stored in second data register 424 is transferred to output selector 325 based on the load signal sent from signal control circuit 5. Second data register 424 also has a storage capacity for ma/2 pieces of pixels.

Output selector 325 makes selection as to which video data of first data register 423 and second data register 424 is to be supplied to latch 327.

The video data transferred to latch 327 is stored once therein, and subjected to voltage conversion by level shifter 328, then supplied to DA converter 329. The video data subjected to conversion from digital signals to analog signals by DA converter 329 is amplified to a specified value by amplifier 330, and then the video data is outputted as display signals to respective display signal lines 30.

Figure 12:
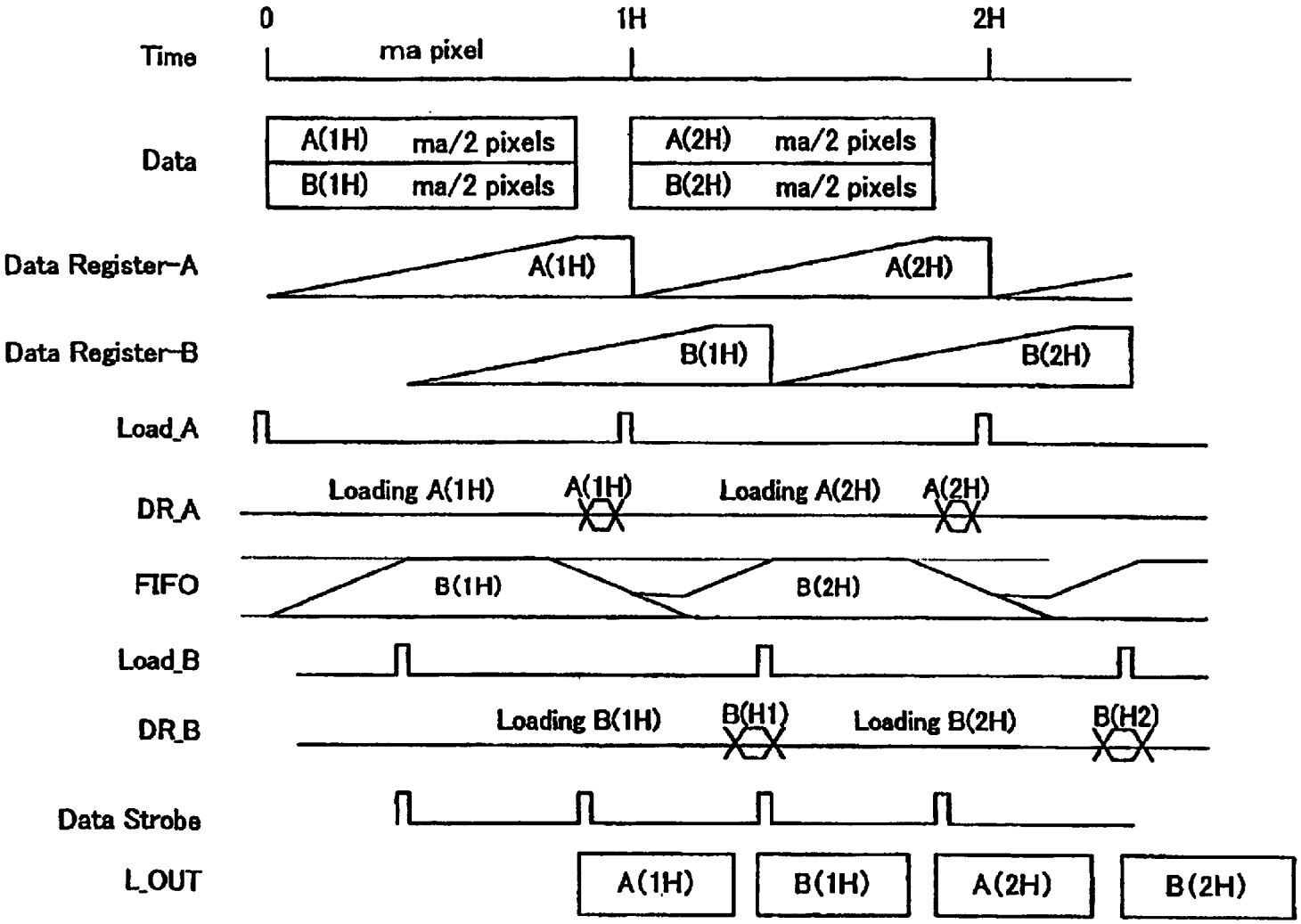
FIG. 12 is a timing chart of the display signals of the liquid crystal display apparatus according to the third embodiment.

Next, description will be made briefly for a supply method of video data in the third embodiment with reference to FIG. 12. FIG. 12 is a timing chart similar to that of FIG. 10.

As shown in FIG. 12, during the first horizontal cycle, driver 32 receives the video data A(1H) and B(1H) from signal control circuit 5. During the next second horizontal cycle, driver 32 receives video data A(2H) and B(2H).

The video data inputted to the driver 32 is distributed to the FIFO 422 and the first data register 423 by the input selector 321. The video data A(1H), A(2H), A(3H) . . . are sent to the first data register 423, and the video data B(1H), B(2H), B(3H) . . . are sent to the FIFO 422. Since the video data is distributed at this stage, the data transfer rate is reduced in half after passing through the input selector 321.

Input lines of the first data register 423 are connected to the entire registers. The first data register 423 writes the video data to a register corresponding to pixel location when a pulse for selecting the inside, which is made of a write signal (Load_A), comes to the first data register 423. Output lines of the first data register 423 exist by the number corresponding to the number of the entire bits. Therefore, the first data register 423 fetches the video data in order from the start pulse of Load_A. This state is shown in rows of "Data Register-A" and "Load_A". Note that the video data A(2H) and A(3H) are processed similarly.

The video data B(1H) is first stored in the FIFO 422. When the data for the ma/4 pieces of pixels is stored in the FIFO 422, the data is fetched in the second data register 424 together with the start pulse of Load_B.

When the input of the video data A(1H) during the first horizontal cycle is ended, the fetch of the video data A(1H) in the first data register 423 is ended. At this point of time, the video data A(1H) in the first data register 423 becomes entirely effective. The period when the video data A(1H) becomes entirely effective is shown by A(1H) in a diagram of the row of DR_A of FIG. 12. After a ½ horizontal cycle from the end of the fetch of the video data A(1H), the fetch of the video data B(1H) in the second data register 424 is ended. At this point of time, the video data B(1H) in the second data register 424 becomes entirely effective. The period when the video data B(1H) becomes entirely effective is shown by B(1H) in a diagram of the row of DR_B of FIG. 12.

When the first data register 423 is effective, the output selector 325 selects DR_A, and when the second data register 424 is effective, the output selector 325 selects DR_B. In this case, in order to send the data to the next step, a data strobe signal (Data Strobe in FIG. 12) is outputted, and the video data A(1H) is latched in the latch 327. The latched video data A(1H) is outputted (L_Out in FIG. 12). Thereafter, the video data is subjected to voltage conversion by the level shifter 328. Then, the video data is subjected to conversion to analog signals by the DA converter 329, and sent to the amplifier 330. From the amplifier 330, the video data is outputted as display signals for driving pixels to the display signal lines 30. As described above, the first storage area and the second storage area of the present invention are not limited to the case of being constituted only of the FIFO 422. The storage areas of the present invention can be realized by appropriately combining storing circuit such as the FIFO 422 and the data register.

As described above, according to the present invention, there can be provided the display signal supply method suitable to the active matrix type display apparatus of applying potentials to two or more adjacent pixels from one display signal line in time division.

Although the preferred embodiments of the present invention have been described in detail, it should be understood that various changes, substitutions and alternations can be made therein without departing from spirit and scope of the inventions as defined by the appended claims.

What is claimed is:

1. A display signal supply apparatus for supplying display signals to an active matrix type image display device, comprising:

a distributing circuit for distributing the display signals input thereto from an outside into a first signal and a second signal;

a first storage area for storing said first signal obtained by distributing the display signals by said distributing circuit;

a second storage area for storing said second signal obtained by distributing the display signals by said distributing circuit; and a signal outputting circuit for instructing an output of said first signal front said first storage area prior to storing said entire first signal in said first storage area; and wherein said signal outputting circuit instructs an output of said second signal stored in said second storage area from said second storage area after said first signal in specified amount is output from said first storage area;

said distributing circuit distributes display signals for m number of pixels into the first signal for m/2 number of pixels and the second signal for the m/2 number of pixels, the signals being input from the outside, and said signal outputting circuit instructs the output of the priorly stored first signal from said first storage area when the first signal for m/4 number of pixels is stored in said first storage area, and instructs the output of said second signal stored in said second storage area from said second storage area after the first signal for the m/2 number of pixels is output from said first storage area.

2. A display signal supply apparatus for supplying display signals to an active matrix type image display device, comprising:

a distributing circuit for distributing the display signals input thereto from an outside into a first signal and a second signal;

a first storage area for storing said first signal obtained by distributing the display signals by said distributing circuit;

a second storage area for storing said second signal obtained by distributing the display signals by said distributing circuit;

a signal outputting circuit for instructing an output of said first signal from said first storage area prior to storing said entire first signal in said first storage area;

a signal control circuit for receiving display signals and clock signals from the outside and for outputting the display signals and control signals; and a driver for receiving said display signals and said control signals, both being output from said signal control circuit, and for supplying said display signals to said image display device based on said control signals, wherein said first storage area and said second storage area are provided in said signal control circuit.

3. A display signal supply apparatus for supplying display signals to an active matrix type image display device, comprising:

a distributing circuit for distributing the display signals input thereto from an outside into a first signal and a second signal;

a first storage area for storing said first signal obtained by distributing the display signals by said distributing circuit;

a second storage area for storing said second signal obtained by distributing the display signals by said distributing circuit;

a signal outputting circuit for instructing an output of said first signal from said first storage area prior to storing said entire first signal in said first storage area;

a signal control circuit for receiving display signals and clock signals from the outside, and for outputting the display signals and control signals; and a driver for receiving said display signals and said control signals, both being output from said signal control circuit, and for supplying said display signals to said image display device based on said control signals, wherein said first storage area and said second storage area are provided in said driver.

4. A display signal supply method for an image display device, said image display device including a plurality of display signal lines for supplying display signals, a plurality of scan signal lines for supplying scan signals, a first pixel electrode disposed between said scan signal lines adjacent to each other and connected to a specified display signal line, and a second pixel electrode connected to said specified display signal line, said display signal supply method comprising the steps of:

receiving display signals for m number of pixels;

after a first display signal corresponding to said first pixel electrode is stored for m/4 number of pixels, while storing said first display signal subsequent thereto, outputting said first signal priorly stored to said first pixel electrode; and after an output of said first display signal is completed, outputting a second display signal corresponding to said second pixel electrode to said second pixel electrode, said second display signal being stored for m/2 number of pixels.

5. The display signal supply method for an image display device according to claim 4, wherein the storage and the output of said first display signal and the storage of said second display signal are performed during one specified horizontal cycle.

6. An image display apparatus, comprising:

an image display device having a plurality of pixels arrayed in a matrix and having display signal lines and scan signal lines provided therein, said display signal lines being for supplying display signals to respective pixels and said scan signal lines being for supplying scan signals to the respective pixels; and a signal processing circuit for generating said display signals based on signals input from an outside and for supplying said display signals to said display signal lines, wherein, said image display device has groups of pixel electrodes, each of which including a first pixel electrode and a second pixel electrode connected to a common display signal line, said first and second pixel electrodes existing in a same row, and said signal processing circuit includes:

a first storage area having a capacity for storing a first display signal to be input to said first pixel electrodes in amount corresponding to a ½ horizontal cycle relating to said first display signal; and a second storage area having a capacity for storing a second display signal to be input to said second pixel electrodes in amount corresponding to one horizontal cycle relating to said second display signal.

7. The image display apparatus according to claim 6, wherein said signal processing circuit receives said first display signal during specified one horizontal cycle, and after said first storage area stores said first display signal in amount corresponding to the ½ horizontal cycle relating to said first display signal, controls said first display signal to be output in storage order.

8. The image display apparatus according to claim 6, wherein said signal processing circuit receives said second display signal during said specified one horizontal cycle, and after said second storage area stores said second display signal in amount corresponding to the one horizontal cycle relating to said second display signal, controls said second display signal to be output in storage order.

9. The image display apparatus according to claim 6, wherein said image display device further includes:

a first switching device having a gate electrode for controlling supply of said display signals, said first switching device being disposed between said common display signal line and said first pixel electrode;

a second switching device disposed between said gate electrode of said first switching device and a specified scan signal line; and a third switching device for controlling supply of said display signals to said second pixel electrode, said third switching device being connected to said specified scan signal line.

10. The image display apparatus according to claim 6, wherein said image display device includes:

a first pixel electrode and a second pixel electrode disposed between an n-th (n: positive integer) scan signal line and an n+1-th scan signal line, to which display signals from a specified signal line are supplied;

a first switching mechanism allowing the scan signals to pass therethrough when both of said n+1-th scan signal line and an n+m-th (m: integer except 0 and 1) scan signal line are selected; and a second switching mechanism allowing the scan signals to pass therethrough to said second pixel electrode when said n+1-th scan signal line is selected.

11. A process for supplying display signals from a storage device to a multiplicity of pixel electrodes in an image display apparatus, said process comprising the steps of:

serially storing display signals into the storage device for at least one quarter of pixels of a line of the image display apparatus; and after the display signals are stored for the at least one quarter of the pixels of the line into the storage device, serially outputting the display signals to respective pixels of said line while concurrently serially storing into the storage device additional display signals for at least another quarter of pixels of the line; and wherein the outputting of said display signals proceeds at approximately twice the rate of the concurrent serial storing of said additional display signals.

12. A process for supplying display signals from a storage device to a multiplicity of pixel electrodes in an image display apparatus, said process comprising the steps of:

serially storing display signals into the storage device for a significant part of a line of the image display apparatus; and after the display signals are stored for the part of the line into the storage device, outputting the display signals while concurrently storing into the storage device additional display signals for another part of the line; and wherein said significant part is approximately half of said line and the outputting step is performed at approximately twice the rate as said concurrent storing step, whereby approximately when said outputting step completes, said storage device is approximately empty of display signals for said line.

13. A process as set forth in claim 11 wherein approximately none of said display signals stored in said storage device is output to said pixel electrodes until said display signals for said quarter of the pixels of said line are stored.

14. A process as set forth in claim 11 wherein some of said display signals are applied from said storage devices to electronic switches which lead to pairs of said pixel electrodes, and other circuitry controls said electronic switches such that successive display signals are applied to successive pixel electrodes.

15. A process for supplying display signals from a storage device to a multiplicity of pixel electrodes in an image display apparatus, said process comprising the steps of:

serially storing display signals into the storage device for a significant part of a line of the image display apparatus; and after the display signals are stored for the part of the line into the storage device, outputting the display signals while concurrently storing into the storage device additional display signals for another part of the line; and wherein other display signals for other pixel electrodes of a line of said image display apparatus are stored into another storage device, and substantially all of said other display signals for said line are stored into said other storage device before said other display signals are output from said other storage device;

the first said storage device and said other storage device share signal lines and/or electronic switches leading to the first said pixel electrodes and said other pixel electrodes; and said other storage device outputs said other display signals while the first said display signals for said significant part of said image device are being stored into said first storage device to avoid contention for said shared signal lines and/or electronic switches.

16. A process as set forth in claim 15 wherein said first data signals are stored into said first storage device at approximately the same rate as said other data signals are stored into said second storage device.

17. A process as set forth in claim 11 wherein said image device comprises a liquid crystal display.

* * * * *